US011578396B2

(12) United States Patent
Somekawa et al.

(10) Patent No.: US 11,578,396 B2
(45) Date of Patent: Feb. 14, 2023

(54) MAGNESIUM-BASED ALLOY WROUGHT PRODUCT AND METHOD FOR PRODUCING SAME

(71) Applicant: National Institute for Materials Science, Ibaraki (JP)

(72) Inventors: Hidetoshi Somekawa, Ibaraki (JP); Yoshiaki Osawa, Ibaraki (JP)

(73) Assignee: National Institute for Materials Science, Ibaraki (JP)

( * ) Notice: Subject to any disclaimer, the term of this patent is extended or adjusted under 35 U.S.C. 154(b) by 282 days.

(21) Appl. No.: 16/632,314

(22) PCT Filed: Jul. 13, 2018

(86) PCT No.: PCT/JP2018/026588
§ 371 (c)(1),
(2) Date: Jan. 17, 2020

(87) PCT Pub. No.: WO2019/017307
PCT Pub. Date: Jan. 24, 2019

(65) Prior Publication Data

US 2020/0173002 A1 Jun. 4, 2020

(30) Foreign Application Priority Data

Jul. 18, 2017 (JP) ..... JP2017-138714

(51) Int. Cl.
*C22F 1/06* (2006.01)
*C22C 23/00* (2006.01)

(52) U.S. Cl.
CPC ..... *C22F 1/06* (2013.01); *C22C 23/00* (2013.01)

(58) Field of Classification Search
CPC ... C22F 1/06; C22F 1/00; C22C 23/00; C22C 23/06
See application file for complete search history.

(56) References Cited

U.S. PATENT DOCUMENTS 3,119,725 A * 1/1964 Foerster ..... C22C 23/00 148/420
2008/0017285 A1 1/2008 Mukai et al.
(Continued)

FOREIGN PATENT DOCUMENTS

CN 101698917 A 4/2010
CN 103060649 A * 4/2013
(Continued)

OTHER PUBLICATIONS

CN-103060649-A, Peng et al.; machine translation. (Year: 2013).*
(Continued)

*Primary Examiner* — John A Hevey
(74) *Attorney, Agent, or Firm* — Trojan Law Offices

(57) ABSTRACT

Provided is Mg-based alloy wrought material having improved ductility, formality, and resistance against fracture. Intermetallic compounds may be formed by mutual bonding of added elements to be a fracture origin. While maintaining microstructure for activating non-basal dislocation movement of Mg-based alloy wrought material, added elements to create no fracture origin, but to promote grain boundary sliding were found from among inexpensive and versatile elements. Provided is Mg-based alloy wrought material including at least one element from Zr, Bi, and Sn and at least one element from Al, Zn, Ca, Li, Y, and Gd wherein remainder comprises Mg and unavoidable impurities; an average grain size in a parent phase is 20 μm or smaller; a value of $(\sigma_{max}-\sigma_{bk})/\sigma_{max}$ (maximum load stress ($\sigma_{max}$), breaking stress ($\sigma_{bk}$)) in a stress-strain curve obtained by tension-compression tests of the wrought material is 0.2 or higher; and resistance against breakage shows 100 kJ or higher.

7 Claims, 3 Drawing Sheets

(56) References Cited

U.S. PATENT DOCUMENTS

| | | | | |
|---|---|---|---|---|
| 2013/0039805 | A1* | 2/2013 | Somekawa | C22C 23/04 420/408 |
| 2014/0332121 | A1* | 11/2014 | Park | C22C 23/02 148/420 |
| 2015/0083285 | A1 | 3/2015 | Somekawa et al. | |
| 2016/0068933 | A1* | 3/2016 | Kawamura | B22D 21/04 420/408 |
| 2019/0078186 | A1 | 3/2019 | Somekawa et al. | |

FOREIGN PATENT DOCUMENTS

| | | | |
|---|---|---|---|
| CN | 106521272 | A | 3/2017 |
| JP | 1990-047237 | A | 2/1990 |
| JP | 2008-214668 | A | 9/2008 |
| JP | 2010-070839 | A | 4/2010 |
| JP | 2016-017183 | A | 2/2016 |
| JP | 2016-089228 | A | 5/2016 |
| WO | 2019013226 | | 1/2019 |

OTHER PUBLICATIONS

First Office Action for related Chinese Patent App. No. 201880047997.2, dated Feb. 3, 2021.

Zhang Fan et al., "Experimental Investigation and Thermodynamic Calculation of the Phase Equilibria in the Mg—Gd—Mn Ternary System". Metallurgical and Materials Transactions A: Physical Metallurgy & Materials Science, ASM International, Materials Park, Oh, U.S., vol. 46, No. 10, Jul. 25, 2015 (Jul. 25, 2015), pp. 4804-4811, XP035533599, ISSN: 1073-5623, DOI: 10.1007/S11661-015-3071-5.

J. Koike et al., "The activity of non-basal slip systems and dynamic recovery at room temperature in fine-grained AZ31B magnesium alloys", Acta Mater, 51 (2003) p. 2055-2065.

* cited by examiner

MAGNESIUM-BASED ALLOY WROUGHT PRODUCT AND METHOD FOR PRODUCING SAME

TECHNICAL FIELD

In embodiments of the present invention, it relates to a magnesium (Mg)-based alloy wrought product (material) having an excellent room temperature ductility and fine crystal grains and a method of manufacturing the same wherein one or more kinds of elements from among four kinds of elements consisting of manganese (Mn), zirconium (Zr), bismuth (Bi), and tin (Sn); and one or more kinds of elements from among six kinds of elements consisting of aluminum (Al), zinc (Zn), calcium (Ca), lithium (Li), yttrium (Y), and gadolinium (Gd) (Here, a combination comprising manganese (Mn) and aluminum (Al) (Hereinafter, it is referred to as "Mn—Al combination", and a similar expression will be used for any one of the other combinations of elements.), a Mn—Zn combination, a Mn—Ca combination, a Mn—Li combination, and a Mn—Y combination are excluded.) are added thereto. More specifically, it relates to the Mg-based alloy wrought material and the method for manufacturing the same, characterized in that no other elements than those mentioned above are added thereto.

BACKGROUND ART

The Mg alloy attracts a lot of attention as the lightweight metal material of the next generation. However, since the crystal structure of Mg metal is hexagonal, the difference of the critical resolved shear stress (CRSS) of basal slip and that of non-basal slip represented by prismatic slip is extremely large at around the room temperature. Therefore, compared to other metal wrought materials such as Al and iron (Fe), it is a difficult-to-machine material with plastic deformation at the room temperature because of its poor ductility.

In order to solve such a technical problem, alloying with addition of a rare earth element is often employed. For example, in the patent reference 1 or 2, an attempt has been made to improve the plastic deformability by adding a rare earth element such as Y, cerium (Ce), and lanthanum (La). This is because the rare earth element may have a role of lowering the CRSS of the non-basal plane, that is, reducing the difference of CRSS's of the basal plane and the non-basal plane so as to facilitate dislocation slip movement of the non-basal plane. However, because of price hikes of raw materials, a substituting material for the rare earth element is in demand from an economic point of view.

On the other hand, near grain boundaries, it is pointed out that complicated stress that is necessary for continuing the deformation, that is, grain boundary compatibility stress works so as to activate non-basal slip (non-patent reference 1). Therefore, it is proposed that introducing a large amount of grain boundaries (crystal grain refinement) is effective on the improvement of ductility.

The patent reference 3 discloses a Mg alloy with refined crystal grains having an excellent strength property in which the crystal grains are refined by containing a small amount of one kind of element from among Ca, Sr, Ba, Sc, Y, La, Ce, Pr, Nd, Pm, Sm, Eu, Gd, Tb, Dy, Ho, Dr, Tm, Yb, and Lu, which are rare earth elements or versatile elements. It is said that increasing the strength of the alloy is mainly caused by segregating these solute elements at grain boundaries. On the other side, the dislocation slip movement of the non-basal plane is activated due to action of the grain boundary compatibility stress in the Mg alloy with refined crystal grains.

However, with respect to the grain boundary sliding effective in complementing the plastic deformation, the grain boundary sliding hardly contributes to the deformation since any of the added elements are effective in preventing the grain boundary sliding. Therefore, the ductility of these alloys at the room temperature is comparable to that of the conventional Mg alloy such that further improvement in the ductility is in demand. That is, it is necessary to find a solute element that would not prevent the grain boundary sliding while the fine structure (microstructure) on which the grain boundary compatibility acts is maintained.

The present inventors focused on adding only one kind of solute element thereto and disclosed that adding 0.07-2 mass % of Mn is effective in improving the room temperature ductility in the patent reference 4 and that adding 0.11-2 mass % of Zr instead of Mn is also effective in improving the room temperature ductility in the patent reference 5. In addition, it was found that adding 0.25-9 mass % of Bi instead of Mn or Zr is also effective in improving the room temperature ductility and a patent application was filed (cf. WO2017/154969 (the patent reference 7)). These alloys are characterized in that the average crystal grain size is not exceeding 10 micrometer and that the elongation at break is around 100% and that the m value is at least 0.1. These alloys are characterized in that the degree of stress reduction, used as the formability index, is at least 0.3. However, from the industrial point of view, it is necessary to be good in the room temperature ductility and the formability in condition of higher speed, that is, in a high rate range. It is also necessary for material constituting a structural object not only to have preferable room temperature ductility and excellent formability in manufacturing a member of the structural object when the material is used for the member, but also to have large fracture resistance (=energy absorption capacity) against the fracture so as not to break abruptly. That is to say, it is desirable to develop a Mg-based alloy having an excellent energy absorption capacity so as not to break abruptly as well as both room temperature ductility and formability.

Generally speaking, in order to improve the fracture resistance against break of metallic material, that is, energy absorption capacity, a plurality of kinds of solute elements are often added. However, in the case where a plurality of elements are added thereto, intermetallic compounds are formed as the added elements are mutually bonded or the added elements are bonded to the parent element (Mg in this case) during a melting process and a heat treatment as well as an expansion forming process. These intermetallic compounds can become a fracture origin as they may act as a stress concentration site during deformation. Therefore, although an additive element exhibits an excellent property in the binary alloy, it is unclear if this effect caused by the additive element in the binary alloy still should be exhibited in a multiple-element system such as the ternary alloy or the quaternary alloy. (Here, the binary alloy is an alloy to which one kind of element is added and the ternary alloy and the quaternary alloy are an alloy to which two kinds of elements are added and an alloy to which three kinds of elements are added, respectively.)

For example, it is known that a rare earth element such as Y is effective as an element to activate non-basal dislocation in the Mg-based binary alloy. However, in a Mg-4 mass % Y-3 mass % MM alloy: commonly known as WE43 alloy (MM: misch metal), it is pointed out that an intermetallic compound containing a rare earth element as a main component is formed in a Mg parent phase such that dispersion of these particles of the compound causes ductility thereof to be lowered. Thus, it is difficult to foresee the effect of adding a plurality of kinds of elements beforehand.

Incidentally, an AM system alloy in the ASTM standard is known and is also disclosed in the patent reference 6. However, in the AM system alloy according to the ASTM standard, Al is added aroud 10 mass % thereto such that a large amount of crystallized product constituted of $Mg_{17}Al_{12}$ might be crystallized out in the Mg mother phase such that it would be concerned that existence of these intermettalic compounds could cause the ductility to be reduced. And the AM system alloy according to the ASTM standard is cast material such that it should be different from the wrought material according to the embodiment of the present invention.

PRIOR ART REFERENCES

Patent References

[Patent Reference 1] WO2013/180122
[Patent Reference 2] JP 2008-214668 A
[Patent Reference 3] JP 2006-16658 A
[Patent Reference 4] JP 2016-17183 A
[Patent Reference 5] JP 2016-89228 A
[Patent Reference 6] JP 2003-328065 A
[Patent Reference 7] WO2017/154969

Non Patent Reference

[Non Patent Reference 1] J. Koike et al., Acta Mater, 51 (2003) p2055.

SUMMARY OF INVENTION

Technical Problem to be Solved by Invention

As mentioned above, it is an object to provide a Mg-based alloy wrought material relatively in an inexpensive manner in the present application since there is a high demand for the Mg-based alloy wrought material that is easily processed by the plastic deformation and, in particular, has an excellent room temperature ductility and formability even in a high speed range and an excellent energy absorption capacity so as not break abruptly.

Means for Solving Technical Problem

Here, there have been no references or disclosed samples in which a Mg-based ternary alloy or quaternary alloy including at least one kind of element from among Mn, Zr, Bi, and Sn; and at least one kind of element from among Al, Zn, Ca, Li, and a rare earth element (Here, a Mg-based alloy with addition of a Mn—Al combination, a Mg-based alloy with addition of a Mn—Zn combination, a Mg-based alloy with addition of a Mn—Ca combination, a Mg-based alloy with addition of a Mn—Li combination, and a Mg-based alloy with addition of a Mn—Y combination are excluded.) has better properties than or equivalent properties to those of a Mg-based binary alloy including any one of Mn, Zr, Bi, and Sn. And, with respect to the AM system alloy accroding to the ASTM Standards and the Mg-based alloy of the patent reference 6, the content amout of Al is at least 2 mass % and it is the primary added metal (having the most additive amount in mol %).

However, after the intensive study, the present inventors found out that a Mg-based alloy wrought material could be provided which had an excellent room temperature formability and deformability and exhibited a large fracture resistance (=energy absorption capacity) against the fracture so as not to break abruptly, if compared to the conventional alloy (for example, AZ31), by hot-working and warm-working with the controlled temperature and reduction ratio of an Mg-based alloy material to which at least one kind of element of the four kinds of elements: Mn, Zr, Bi, and Sn and at least one kind of element of the six kinds of elements: Al, Zn, Ca, Li, Y, and Gd were added (Here, a Mg-based alloy with addition of a Mn—Al combination, a Mg-based alloy with addition of a Mn—Zn combination, a Mg-based alloy with addition of a Mn—Ca combination, a Mg-based alloy with addition of a Mn—Li combination, and a Mg-based alloy with addition of a Mn—Y combination are excluded.). Here, the wrought material is a generic term of the material worked and formed into a plate-like, tubular, rod-like, or threadlike shape through a plastic-strain applying process in a hot temperature (hot-working), a warm temperature (warm-working), or a cold temperature (cold-working) such as rolling, extruding, drawing, and forging.

Concretely, the following are provided.

[1] In an embodiment of the present invention, a Mg-based alloy wrought material is characterized by comprising Mg-A mol % X-B mol % Z wherein the remainder comprises Mg and unavoidable impurities, wherein X is one or more kinds of elements from Bi, Sn, and Zr.

wherein Z is one or more kinds of elements from Al, Zn, Ca, Li, Y, and Gd, wherein a value of A is at least 0.03 mol %, but not exceeding 1 mol %, wherein, with respect to the relationship of A and B, A≥B and the upper limit of B is 1.0 times as large as or less than the upper limit of A and the lower limit of B is at least 0.03 mol %, and wherein an average crystal grain size of the Mg-based alloy wrought material is not exceeding 20 micrometer. Here, in general, the Mg-based alloy wrought material is manufactured by melting raw metal material, casting the melt, performing a solution treatment of the cast alloy, and applying plastic strain to the cast alloy after the solution treatment. Here, the solution treatment of the cast alloy may comprise a heat treatment of the cast material in a predetermined atmosphere and in a predetermined temperature range. For example, it can comprise heat treating the Mg-based alloy cast material in an air atmosphere or in a carbon dioxide atmosphere at a temperature of at least 400 degree Celsius and not exceeding 650 degree Celsius for at least 0.5 hours and not exceeding 48 hours. Preferably, the heat treatment may be performed at a temperature of at least 450 degree Celsius and not exceeding 625 degree Celsius for at least one (1) hour and not exceeding 24 hours. More preferably, the heat treatment may be performed at a temperature of at least 500 degree Celsius and not exceeding 600 degree Celsius for at least two (2) hours and not exceeding 12 hours. And the plastic-strain applying process may include conducting a hot plastic working in a predetermined temperature range. The plastic-strain applying process may include conducting a hot plastic working in an air atmosphere or an inert atmosphere in a predetermined temperature range such as at least 50 degree Celsius and not exceeding 550 degree Celusius, for example. The hot plastic working may be characterized by, for example, the cross-section reduction rate=(cross-section area of raw material−cross-section area of processed material)/cross-section area of raw material×100%. In the hot plastic working, the cross-section reduction rate may be at least 70%.

Here, that X is one or more kinds of elements from Bi, Sn, and Zr means that X is any one selected from the 7 element combinations consisting of Bi, Sn, Zr, Bi—Sn, Bi—Zr, Sn—Zr, and Bi—Sn—Zr.

That Z is one or more kinds of elements from Al, Zn, Ca, Li, Y, and Gd means that Z is any one selected from (1) to (6) element combinations as follows.

(1) In the case where one kind of element is selected: Al, Zn, Ca, Li, Y, or Gd;

(2) In the case where two kinds of element are selected: Al—Zn, Al—Ca, Al—Li, Al—Y, Al—Gd, Zn—Ca, Zn—Li, Zn—Y, Zn—Gd, Ca—Li, Ca—Y, Ca—Gd, Li—Y, Li—Gd, or Y—Gd;

(3) In the case where three kinds of element are selected: Al—Zn—Ca, Al—Zn—Li, Al—Zn—Y, Al—Zn—Gd, Al—Ca—Li, Al—Ca—Y, Al—Ca—Gd, Al—Li—Y, Al—Li—Gd, Al—Y—Gd, Zn—Ca—Li, Zn—Ca—Y, Zn—Ca—Gd, Zn—Li—Y, Zn—Li—Gd, Zn—Y—Gd, Ca—Li—Y, Ca—Li—Gd, Ca—Y—Gd, or Li—Y—Gd;

(4) In the case where four kinds of element are selected: Al—Zn—Ca—Li, Al—Zn—Ca—Y, Al—Zn—Ca—Gd, Al—Zn—Li—Y, Al—Zn—Li—Gd, Al—Zn—Y—Gd, Al—Ca—Li—Y, Al—Ca—Li—Gd, Al—Ca—Y—Gd, Al—Li—Y—Gd, Zn—Ca—Li—Y, Zn—Ca—Li—Gd, Zn—Ca—Y—Gd, Zn—Li—Y—Gd, or Ca—Li—Y—Gd;

(5) In the case where five kinds of element are selected: Al—Zn—Ca—Li—Y, Al—Zn—Ca—Li—Gd, Al—Zn—Ca—Y—Gd, Al—Zn—Li—Y—Gd, Al—Ca—Li—Y—Gd, or Zn—Ca—Li—Y—Gd;

(6) In the case where six kinds of element are selected: Al—Zn—Ca—Li—Y—Gd.

Therefore, the Mg-based alloy having any one of X-and-Z combinations wherein the remainder comprises Mg and unavoidable impurities is referred to any one of the following expressions in terms of only X and Z combinations.

Provided is the Mg-based alloy which includes any one additive element combination, wherein the remainder comprises Mg and unavoidable impurities, selected from: Bi—Al, Bi—Zn, Bi—Ca, Bi—Li, Bi—Y, or Bi—Gd, or Bi—Al—Zn, Bi—Al—Ca, Bi—Al—Li, Bi—Al—Y, Bi—Al—Gd, Bi—Zn—Ca, Bi—Zn—Li, Bi—Zn—Y, Bi—Zn—Gd, Bi—Ca—Li, Bi—Ca—Y, Bi—Ca—Gd, Bi—Li—Y, Bi—Li—Gd, or Bi—Y—Gd, or Bi—Al—Zn—Ca, Bi—Al—Zn—Li, Bi—Al—Zn—Y, Bi—Al—Zn—Gd, Bi—Al—Ca—Li, Bi—Al—Ca—Y, Bi—Al—Ca—Gd, Bi—Al—Li—Y, Bi—Al—Li—Gd, Bi—Al—Y—Gd, Bi—Zn—Ca—Li, Bi—Zn—Ca—Y, Bi—Zn—Ca—Gd, Bi—Zn—Li—Y, Bi—Zn—Li—Gd, Bi—Zn—Y—Gd, Bi—Ca—Li—Y, Bi—Ca—Li—Gd, Bi—Ca—Y—Gd, or Bi—Li—Y—Gd, or Bi—Al—Zn—Ca—Li, Bi—Al—Zn—Ca—Y, Bi—Al—Zn—Ca—Gd, Bi—Al—Zn—Li—Y, Bi—Al—Zn—Li—Gd, Bi—Al—Zn—Y—Gd, Bi—Al—Ca—Li—Y, Bi—Al—Ca—Li—Gd, Bi—Al—Ca—Y—Gd, Bi—Al—Li—Y—Gd, Bi—Zn—Ca—Li—Y, Bi—Zn—Ca—Li—Gd, Bi—Zn—Ca—Y—Gd, Bi—Zn—Li—Y—Gd, or Bi—Ca—Li—Y—Gd, or Bi—Al—Zn—Ca—Li—Y, Bi—Al—Zn—Ca—Li—Gd, Bi—Al—Zn—Ca—Y—Gd, Bi—Al—Zn—Li—Y—Gd, Bi—Al—Ca—Li—Y—Gd, or Bi—Zn—Ca—Li—Y—Gd, or Bi—Al—Zn—Ca—Li—Y—Gd; or Sn—Al, Sn—Zn, Sn—Ca, Sn—Li, Sn—Y, or Sn—Gd, Sn—Al—Zn, Sn—Al—Ca, Sn—Al—Li, Sn—Al—Y, Sn—Al—Gd, Sn—Zn—Ca, Sn—Zn—Li, Sn—Zn—Y, Sn—Zn—Gd, Sn—Ca—Li, Sn—Ca—Y, Sn—Ca—Gd, Sn—Li—Y, Sn—Li—Gd, or Sn—Y—Gd, or Sn—Al—Zn—Ca, Sn—Al—Zn—Li, Sn—Al—Zn—Y, Sn—Al—Zn—Gd, Sn—Al—Ca—Li, Sn—Al—Ca—Y, Sn—Al—Ca—Gd, Sn—Al—Li—Y, Sn—Al—Li—Gd, Sn—Al—Y—Gd, Sn—Zn—Ca—Li, Sn—Zn—Ca—Y, Sn—Zn—Ca—Gd, Sn—Zn—Li—Y, Sn—Zn—Li—Gd, Sn—Zn—Y—Gd, Sn—Ca—Li—Y, Sn—Ca—Li—Gd, Sn—Ca—Y—Gd, or Sn—Li—Y—Gd, or Sn—Al—Zn—Ca—Li, Sn—Al—Zn—Ca—Y, Sn—Al—Zn—Ca—Gd, Sn—Al—Zn—Li—Y, Sn—Al—Zn—Li—Gd, Sn—Al—Zn—Y—Gd, Sn—Al—Ca—Li—Y, Sn—Al—Ca—Li—Gd, Sn—Al—Ca—Y—Gd, Sn—Al—Li—Y—Gd, Sn—Zn—Ca—Li—Y, Sn—Zn—Ca—Li—Gd, Sn—Zn—Ca—Y—Gd, Sn—Zn—Li—Y—Gd, or Sn—Ca—Li—Y—Gd, or Sn—Al—Zn—Ca—Li—Y, Sn—Al—Zn—Ca—Li—Gd, Sn—Al—Zn—Ca—Y—Gd, Sn—Al—Zn—Li—Y—Gd, Sn—Al—Ca—Li—Y—Gd, or Sn—Zn—Ca—Li—Y—Gd, or Sn—Al—Zn—Ca—Li—Y—Gd; or Zr—Al, Zr—Zn, Zr—Ca, Zr—Li, Zr—Y, or Zr—Gd, or Zr—Al—Zn, Zr—Al—Ca, Zr—Al—Li, Zr—Al—Y, Zr—Al—Gd, Zr—Zn—Ca, Zr—Zn—Li, Zr—Zn—Y, Zr—Zn—Gd, Ca—Li, Zr—Ca—Y, Zr—Ca—Gd, Zr—Li—Y, Zr—Li—Gd, or Zr—Y—Gd, or Zr—Al—Zn—Ca, Zr—Al—Zn—Li, Zr—Al—Zn—Y, Zr—Al—Zn—Gd, Zr—Al—Ca—Li, Zr—Al—Ca—Y, Zr—Al—Ca—Gd, Zr—Al—Li—Y, Zr—Al—Li—Gd, Zr—Al—Y—Gd, Zr—Zn—Ca—Li, Zr—Zn—Ca—Y, Zr—Zn—Ca—Gd, Zr—Zn—Li—Y, Zr—Zn—Li—Gd, Zr—Zn—Y—Gd, Zr—Ca—Li—Y, Zr—Ca—Li—Gd, Zr—Ca—Y—Gd, or Zr—Li—Y—Gd, or Zr—Al—Zn—Ca—Li, Zr—Al—Zn—Ca—Y, Zr—Al—Zn—Ca—Gd, Zr—Al—Zn—Li—Y, Zr—Al—Zn—Li—Gd, Zr—Al—Zn—Y—Gd, Zr—Al—Ca—Li—Y, Zr—Al—Ca—Li—Gd, Zr—Al—Ca—Y—Gd, Zr—Al—Li—Y—Gd, Zr—Zn—Ca—Li—Y, Zr—Zn—Ca—Li—Gd, Zr—Zn—Ca—Y—Gd, Zr—Zn—Li—Y—Gd, or Zr—Ca—Li—Y—Gd, or Zr—Al—Zn—Ca—Li—Y, Zr—Al—Zn—Ca—Li—Gd, Zr—Al—Zn—Ca—Y—Gd, Zr—Al—Zn—Li—Y—Gd, Zr—Al—Ca—Li—Y—Gd, or Zr—Zn—Ca—Li—Y—Gd, or Zr—Al—Zn—Ca—Li—Y—Gd; or Bi—Sn—Al, Bi—Sn—Zn, Bi—Sn—Ca, Bi—Sn—Li, Bi—Sn—Y, or Bi—Sn—Gd, or Bi—Sn—Al—Zn, Bi—Sn—Al—Ca, Bi—Sn—Al—Li, Bi—Sn—Al—Y, Bi—Sn—Al—Gd, Bi—Sn—Zn—Ca, Bi—Sn—Zn—Li, Bi—Sn—Zn—Y, Bi—Sn—Zn—Gd, Bi—Sn—Ca—Li, Bi—Sn—Ca—Y, Bi—Sn—Ca—Gd, Bi—Sn—Li—Y, Bi—Sn—Li—Gd, or Bi—Sn—Y—Gd, or Bi—Sn—Al—Zn—Ca, Bi—Sn—Al—Zn—Li, Bi—Sn—Al—Zn—Y, Bi—Sn—Al—Zn—Gd, Bi—Sn—Al—Ca—Li, Bi—Sn—Al—Ca—Y, Bi—Sn—Al—Ca—Gd, Bi—Sn—Al—Li—Y, Bi—Sn—Al—Li—Gd, Bi—Sn—Al—Y—Gd, Bi—Sn—Zn—Ca—Li, Bi—Sn—Zn—Ca—Y, Bi—Sn—Zn—Ca—Gd, Bi—Sn—Zn—Li—Y, Bi—Sn—Zn—Li—Gd, Bi—Sn—Zn—Y—Gd, Bi—Sn—Ca—Li—Y, Bi—Sn—Ca—Li—Gd, Bi—Sn—Ca—Y—Gd, or Bi—Sn—Li—Y—Gd, or Bi—Sn—Al—Zn—Ca—Li, Bi—Sn—Al—Zn—Ca—Y, Bi—Sn—Zn—Ca—Gd, Bi—Sn—Al—Zn—Li—Y, Bi—Sn—Al—Zn—Li—Gd, Bi—Sn—Al—Zn—Y—Gd, Bi—Sn—Al—Ca—Li—Y, Bi—Sn—Al—Ca—Li—Gd, Bi—Sn—Al—Ca—Y—Gd, Bi—Sn—Al—Li—Y—Gd, Bi—Sn—Zn—Ca—Li—Y, Bi—Sn—Zn—Ca—Li—Gd, Bi—Sn—Zn—Ca—Y—Gd, Bi—Sn—Zn—Li—Y—Gd, or Bi—Sn—Ca—Li—Y—Gd, or Bi—Sn—Al—Zn—Ca—Li—Y, Bi—Sn—Al—Zn—Ca—Li—Gd, Bi—Sn—Al—Zn—Ca—Y—

Gd, Bi—Sn—Al—Zn—Li—Y—Gd, Bi—Sn—Al—Ca—Li—Y—Gd, Bi—Sn—Zn—Ca—Li—Y—Gd, or Bi—Sn—Al—Zn—Ca—Li—Y—Gd; or

Bi—Zr—Al, Bi—Zr—Zn, Bi—Zr—Ca, Bi—Zr—Li, Bi—Zr—Y, or Bi—Zr—Gd, or Bi—Zr—Al—Zn, Bi—Zr—Al—Ca, Bi—Zr—Al—Li, Bi—Zr—Al—Y, Bi—Zr—Al—Gd, Bi—Zr—Zn—Ca, Bi—Zr—Zn—Li, Bi—Zr—Zn—Y, Bi—Zr—Zn—Gd, Bi—Zr—Ca—Li, Bi—Zr—Ca—Y, Bi—Zr—Ca—Gd, Bi—Zr—Li—Y, Bi—Zr—Li—Gd, or Bi—Zr—Y—Gd, or Bi—Zr—Al—Zn—Ca, Bi—Zr—Al—Zn—Li, Bi—Zr—Al—Zn—Y, Bi—Zr—Al—Zn—Gd, Bi—Zr—Al—Ca—Li, Bi—Zr—Al—Ca—Y, Bi—Zr—Al—Ca—Gd, Bi—Zr—Al—Li—Y, Bi—Zr—Al—Li—Gd, Bi—Zr—Al—Y—Gd, Bi—Zr—Zn—Ca—Li, Bi—Zr—Zn—Ca—Y, Bi—Zr—Zn—Ca—Gd, Bi—Zr—Zn—Li—Y, Bi—Zr—Zn—Li—Gd, Bi—Zr—Zn—Y—Gd, Bi—Zr—Ca—Li—Y, Bi—Zr—Ca—Li—Gd, Bi—Zr—Ca—Y—Gd, or Bi—Zr—Li—Y—Gd, or Bi—Zr—Al—Zn—Ca—Li, Bi—Zr—Al—Zn—Ca—Y, Bi—Zr—Al—Zn—Ca—Gd, Bi—Zr—Al—Zn—Li—Y, Bi—Zr—Al—Zn—Li—Gd, Bi—Zr—Al—Zn—Y—Gd, Bi—Zr—Al—Ca—Li—Y, Bi—Zr—Al—Ca—Li—Gd, Bi—Zr—Al—Ca—Y—Gd, Bi—Zr—Al—Li—Y—Gd, Bi—Zr—Zn—Ca—Li—Y, Bi—Zr—Zn—Ca—Li—Gd, Bi—Zr—Zn—Ca—Y—Gd, Bi—Zr—Zn—Li—Y—Gd, or Bi—Zr—Ca—Li—Y—Gd, or Bi—Zr—Al—Zn—Ca—Li—Y, Bi—Zr—Al—Zn—Ca—Li—Gd, Bi—Zr—Al—Zn—Ca—Y—Gd, Bi—Zr—Al—Zn—Li—Y—Gd, Bi—Zr—Al—Ca—Li—Y—Gd, or Bi—Zr—Zn—Ca—Li—Y—Gd, or Bi—Zr—Al—Zn—Ca—Li—Y—Gd; or

Sn—Zr—Al, Sn—Zr—Zn, Sn—Zr—Ca, Sn—Zr—Li, Sn—Zr—Y, or Sn—Zr—Gd, or Sn—Zr—Al—Zn, Sn—Zr—Al—Ca, Sn—Zr—Al—Li, Sn—Zr—Al—Y, Sn—Zr—Al—Gd, Sn—Zr—Zn—Ca, Sn—Zr—Zn—Li, Sn—Zr—Zn—Y, Sn—Zr—Zn—Gd, Sn—Zr—Ca—Li, Sn—Zr—Ca—Y, Sn—Zr—Ca—Gd, Sn—Zr—Li—Y, Sn—Zr—Li—Gd, or Sn—Zr—Y—Gd, or Sn—Zr—Al—Zn—Ca, Sn—Zr—Al—Zn—Li, Sn—Zr—Al—Zn—Y, Sn—Zr—Al—Zn—Gd, Sn—Zr—Al—Ca—Li, Sn—Zr—Al—Ca—Y, Sn—Zr—Al—Ca—Gd, Sn—Zr—Al—Li—Y, Sn—Zr—Al—Li—Gd, Sn—Zr—Al—Y—Gd, Sn—Zr—Zn—Ca—Li, Sn—Zr—Zn—Ca—Y, Sn—Zr—Zn—Ca—Gd, Sn—Zr—Zn—Li—Y, Sn—Zr—Zn—Li—Gd, Sn—Zr—Zn—Y—Gd, Sn—Zr—Ca—Li—Y, Sn—Zr—Ca—Li—Gd, Sn—Zr—Ca—Y—Gd, or Sn—Zr—Li—Y—Gd, or Sn—Zr—Al—Zn—Ca—Li, Sn—Zr—Al—Zn—Ca—Y, Sn—Zr—Al—Zn—Ca—Gd, Sn—Zr—Al—Zn—Li—Y, Sn—Zr—Al—Zn—Li—Gd, Sn—Zr—Al—Zn—Y—Gd, Sn—Zr—Al—Ca—Li—Y, Sn—Zr—Al—Ca—Li—Gd, Sn—Zr—Al—Ca—Y—Gd, Sn—Zr—Al—Li—Y—Gd, Sn—Zr—Zn—Ca—Li—Y, Sn—Zr—Zn—Ca—Li—Gd, Sn—Zr—Zn—Ca—Y—Gd, Sn—Zr—Zn—Li—Y—Gd, or Sn—Zr—Ca—Li—Y—Gd, or Sn—Zr—Al—Zn—Ca—Li—Y, Sn—Zr—Al—Zn—Ca—Li—Gd, Sn—Zr—Al—Zn—Ca—Y—Gd, Al—Zn—Li—Y—Gd, Sn—Zr—Al—Ca—Li—Y—Gd, or Sn—Zr—Zn—Ca—Li—Y—Gd, or Sn—Zr—Al—Zn—Ca—Li—Y—Gd; or

Bi—Sn—Zr—Al, Bi—Sn—Zr—Zn, Bi—Sn—Zr—Ca, Bi—Sn—Zr—Li, Bi—Sn—Zr—Y, or Bi—Sn—Zr—Gd, or Bi—Sn—Zr—Al—Zn, Bi—Sn—Zr—Al—Ca, Bi—Sn—Zr—Al—Li, Bi—Sn—Zr—Al—Y, Bi—Sn—Zr—Al—Gd, Bi—Sn—Zr—Zn—Ca, Bi—Sn—Zr—Zn—Li, Bi—Sn—Zr—Zn—Y, Bi—Sn—Zr—Zn—Gd, Bi—Sn—Zr—Ca—Li, Bi—Sn—Zr—Ca—Y, Bi—Sn—Zr—Ca—Gd, Bi—Sn—Zr—Li—Y, Bi—Sn—Zr—Li—Gd, or Bi—Sn—Zr—Y—Gd, or Bi—Sn—Zr—Al—Zn—Ca, Bi—Sn—Zr—Al—Zn—Li, Bi—Sn—Zr—Al—Zn—Y, Bi—Sn—Zr—Al—Zn—Gd, Bi—Sn—Zr—Al—Ca—Li, Bi—Sn—Zr—Al—Ca—Y, Bi—Sn—Zr—Al—Ca—Gd, Bi—Sn—Zr—Al—Li—Y, Bi—Sn—Zr—Al—Li—Gd, Bi—Sn—Zr—Al—Y—Gd, Bi—Sn—Zr—Zn—Ca—Li, Bi—Sn—Zr—Zn—Ca—Y, Bi—Sn—Zr—Zn—Ca—Gd, Bi—Sn—Zr—Zn—Li—Y, Bi—Sn—Zr—Zn—Li—Gd, Bi—Sn—Zr—Zn—Y—Gd, Bi—Sn—Zr—Ca—Li—Y, Bi—Sn—Zr—Ca—Li—Gd, Bi—Sn—Zr—Ca—Y—Gd, or Bi—Sn—Zr—Li—Y—Gd, or Bi—Sn—Zr—Al—Zn—Ca—Li, Bi—Sn—Zr—Al—Zn—Ca—Y, Bi—Sn—Zr—Al—Zn—Ca—Gd, Bi—Sn—Zr—Al—Zn—Li—Y, Bi—Sn—Zr—Al—Zn—Li—Gd, Bi—Sn—Zr—Al—Zn—Y—Gd, Bi—Sn—Zr—Al—Ca—Li—Y, Bi—Sn—Zr—Al—Ca—Li—Gd, Bi—Sn—Zr—Al—Ca—Y—Gd, Bi—Sn—Zr—Al—Li—Y—Gd, Bi—Sn—Zr—Al—Li—Gd, Bi—Sn—Zr—Al—Y—Gd, Bi—Sn—Zr—Zn—Ca—Li, Bi—Sn—Zr—Zn—Ca—Y, Bi—Sn—Zr—Zn—Ca—Gd, Bi—Sn—Zr—Zn—Li—Y, Bi—Sn—Zr—Zn—Li—Gd, Bi—Sn—Zr—Zn—Y—Gd, Bi—Sn—Zr—Ca—Li—Y, Bi—Sn—Zr—Ca—Li—Gd, Bi—Sn—Zr—Ca—Y—Gd, or Bi—Sn—Zr—Li—Y—Gd, or Bi—Sn—Zr—Al—Zn—Ca—Li, Bi—Sn—Zr—Al—Zn—Ca—Y, Bi—Sn—Zr—Al—Zn—Ca—Gd, Bi—Sn—Zr—Al—Zn—Li—Y, Bi—Sn—Zr—Al—Zn—Li—Gd, Bi—Sn—Zr—Al—Zn—Y—Gd, Bi—Sn—Zr—Al—Ca—Li—Y, Bi—Sn—Zr—Al—Ca—Li—Gd, Bi—Sn—Zr—Al—Ca—Y—Gd, Bi—Sn—Zr—Al—Li—Y—Gd, Bi—Sn—Zr—Al—Li—Gd, Bi—Sn—Zr—Al—Y—Gd, Bi—Sn—Zr—Zn—Ca—Li, Bi—Sn—Zr—Zn—Ca—Y, Bi—Sn—Zr—Zn—Ca—Gd, Bi—Sn—Zr—Zn—Li—Y, Bi—Sn—Zr—Zn—Li—Gd, Bi—Sn—Zr—Zn—Y—Gd, Bi—Sn—Zr—Ca—Li—Y, Bi—Sn—Zr—Ca—Li—Gd, Bi—Sn—Zr—Ca—Y—Gd, Bi—Sn—Zr—Li—Y—Gd, or Bi—Sn—Zr—Al—Zn—Ca—Li, Bi—Sn—Zr—Al—Zn—Ca—Y, Bi—Sn—Zr—Al—Zn—Ca—Gd, Bi—Sn—Zr—Al—Zn—Li—Y, Bi—Sn—Zr—Al—Zn—Li—Gd, Bi—Sn—Zr—Al—Zn—Y—Gd, Bi—Sn—Zr—Al—Ca—Li—Y, Bi—Sn—Zr—Al—Ca—Li—Gd, Bi—Sn—Zr—Al—Ca—Y—Gd, Bi—Sn—Zr—Al—Li—Y—Gd, Bi—Sn—Zr—Al—Li—Gd, Bi—Sn—Zr—Al—Y—Gd, Bi—Sn—Zr—Zn—Ca—Li, Bi—Sn—Zr—Zn—Ca—Y, Bi—Sn—Zr—Zn—Ca—Gd, Bi—Sn—Zr—Zn—Li—Y, Bi—Sn—Zr—Zn—Li—Gd, Bi—Sn—Zr—Zn—Y—Gd, Bi—Sn—Zr—Ca—Li—Y, Bi—Sn—Zr—Ca—Li—Gd, Bi—Sn—Zr—Ca—Y—Gd, Bi—Sn—Zr—Li—Y—Gd, or Bi—Sn—Zr—Al—Zn—Ca—Li—Y, Bi—Sn—Zr—Al—Zn—Ca—Y, Bi—Sn—Zr—Al—Zn—Ca—Gd, Bi—Sn—Zr—Al—Zn—Li—Y, Bi—Sn—Zr—Al—Zn—Li—Gd, Bi—Sn—Zr—Al—Zn—Y—Gd, Bi—Sn—Zr—Al—Ca—Li—Y, Bi—Sn—Zr—Al—Ca—Li—Gd, Bi—Sn—Zr—Al—Ca—Y—Gd, Bi—Sn—Zr—Al—Li—Y—Gd, Bi—Sn—Zr—Al—Li—Gd, Bi—Sn—Zr—Al—Y—Gd, Bi—Sn—Zr—Zn—Ca—Li, Bi—Sn—Zr—Zn—Ca—Y, Bi—Sn—Zr—Zn—Ca—Gd, Bi—Sn—Zr—Zn—Li—Y, Bi—Sn—Zr—Zn—Li—Gd, Bi—Sn—Zr—Zn—Y—Gd, Bi—Sn—Zr—Ca—Li—Y, Bi—Sn—Zr—Ca—Li—Gd, Bi—Sn—Zr—Ca—Y—Gd, Bi—Sn—Zr—Li—Y—Gd, or Bi—Sn—Zr—Al—Zn—Ca—Li, Bi—Sn—Zr—Al—Zn—Ca—Y, Bi—Sn—Zr—Al—Zn—Ca—Gd, Bi—Sn—Zr—Al—Zn—Li—Y, Bi—Sn—Zr—Al—Zn—Li—Gd, Bi—Sn—Zr—Al—Zn—Y—Gd, Bi—Sn—Zr—Al—Ca—Li—Y, Bi—Sn—Zr—Al—Ca—Li—Gd, Bi—Sn—Zr—Al—Ca—Y—Gd, Bi—Sn—Zr—Al—Li—Y—Gd, Bi—Sn—Zr—Al—Li—Gd, Bi—Sn—Zr—Al—Y—Gd, Bi—Sn—Zr—Zn—Ca—Li, Bi—Sn—Zr—Zn—Ca—Y, Bi—Sn—Zr—Zn—Ca—Gd, Bi—Sn—Zr—Zn—Li—Y, Bi—Sn—Zr—Zn—Li—Gd, Bi—Sn—Zr—Zn—Y—Gd, Bi—Sn—Zr—Ca—Li—Y, Bi—Sn—Zr—Ca—Li—Gd, Bi—Sn—Zr—Ca—Y—Gd, Bi—Sn—Zr—Li—Y—Gd, or Bi—Sn—Zr—Al—Zn—Ca—Li—Y, Bi—Sn—Zr—Al—Zn—Ca—Y, Bi—Sn—Zr—Al—Zn—Ca—Li—Gd, Bi—Sn—Zr—Al—Zn—Ca—Y—Gd, Bi—Sn—Zr—Al—Zn—Li—Y—Gd, Bi—Sn—Zr—Al—Ca—Li—Y—Gd, or Bi—Sn—Zr—Zn—Ca—Li—Y—Gd, or Bi—Sn—Zr—Al—Zn—Ca—Li—Y—Gd.

The Mg-based alloy wrought material comprises such a Mg-based alloy.

[2] In an embodiment of the present invention, a Mg-based alloy wrought material comprising: Mg-A mol % Mn-B mol % Gd wherein a remainder comprises Mg and unavoidable impurities, wherein the Mg-based alloy does not include Al, wherein a value of A is at least 0.03 mol % and not exceeding 1 mol %, wherein, with respect to a relationship of A and B, A≥B and an upper limit of B is 1.0 times as large as or less than an upper limit of A and a lower limit of B is at least 0.03 mol %, and wherein an average crystal grain size of a Mg parent phase of the Mg-based alloy wrought material is not exceeding 20 micrometer.

[3] In an embodiment of the present invention, a Mg-based alloy wrought material comprising: Mg-A mol % (Mn, X)-B mol % Gd wherein a remainder comprises Mg and unavoidable impurities, wherein X is at least one kind of element selected from Bi, Sn, and Zr, wherein a value of A is at least 0.03 mol % and not exceeding 1 mol %, wherein, with respect to a relationship of A and B, A≥B and an upper limit of B is 1.0 times as large as or less than an upper limit of A and a lower limit of B is at least 0.03 mol %, and wherein an average crystal grain size of the Mg-based alloy wrought material is not exceeding 20 micrometer.

Here, the expression of A mol % (Mn, X) is referred to a composition material mixed with Mn and at least one kind of element selected from Bi, Sn, and Zr having a concentration of A mol % in total. More specifically, provided is any one selected from A mol % (Mn, Bi), A mol % (Mn, Sn), A mol % (Mn, Zr), A mol % (Mn, Bi, Sn), A mol % (Mn, Bi, Zr), A mol % (Mn, Sn, Zr), or A mol % (Mn, Bi, Sn, Zr).

And, as a Mg-based alloy material of the Mg-based wrought material, the following is provided wherein a remainder thereof comprises Mg and unavoidable impurities.

It is any one selected from Mg-A mol % (Mn, Bi)-B mol % Gd, Mg-A mol % (Mn, Sn)-B mol % Gd, Mg-A mol % (Mn, Zr)-B mol % Gd, Mg-A mol % (Mn, Bi, Sn)-B mol % Gd, Mg-A mol % (Mn, Bi, Zr)-B mol % Gd, Mg-A mol % (Mn, Sn, Zr)-B mol % Gd, or Mg-A mol % (Mn, Bi, Sn, Zr)-B mol % Gd.

[4] In an embodiment of the present invention, the Mg-based alloy wrought material is characterized by the Mg-based alloy wrought material according to any one of the above [1] to [3] wherein intermetallic compound particles having an average diameter of not exceeding 0.5 micrometer exist in Mg parent phase or crystal grain boundaries of a metallographic structure of the Mg-based alloy wrought material. Here, the intermetallic compound particles refer to a crystalline mixture comprising Mg element and added elements. And the intermetallic compound particles can refer to particles comprising an intermetallic compound comprising a compound or a mixture of parent phase elements and added elements. In general, the intermetallic compound is said to refer to a compound that is constituted of two or more kinds of metals wherein atomic ratios of constituent elements are composed of integers and exhibits specific physical and chemical properties other than those of the ingredient elements. The shapes of the particles could be in a spherical shape, a needle shape, and a plate shape depending on respective compositions.

[5] In an embodiment of the present invention, the Mg-based alloy wrought material is characterized by a Mg-based alloy wrought material described in any one of the above [1] to [4], wherein the value of the formula of $(\sigma_{max}-\sigma_{bk})/\sigma_{max}$ is 0.2 or more when the maximum applied stress is defined as $(\sigma_{max})$ and the stress at break is defined as $(\sigma_{bk})$ in a stress-strain diagram obtained by the room temperature tensile test in which an initial strain rate of the wrought material is set to $1\times10^{-4}$ $s^{-1}$ or less. In an embodiment of the present invention, since the value of the degree of stress reduction $(\sigma_{max}-\sigma_{bk})/\sigma_{max}$ is at least 0.2, the room temperature ductility is excellent if compared to that of the conventional alloy (for example, AZ31).

[6] In an embodiment of the present invention, the Mg-based alloy wrought material is characterized by a Mg-based alloy wrought material as described in any one of the above [1] to [5], comprising: a Mg-base alloy wherein the Mg-based alloy does not break even if the nominal strain of 0.2 or more is applied in the room temperature tensile test and/or compression test in which the initial strain rate is set to $1\times10^{-4}$ $s^{-1}$ or less. In an embodiment of the present invention, since no break occurs even if at least 0.2 of nominal strain is applied, the room temperature ductility is excellent if compared to that of the conventional alloy (for example, AZ31) such that it would not break abruptly.

[7] In an embodiment of the present invention, the Mg-based alloy wrought material is characterized by a Mg-based alloy wrought material as described in any one of the above [1] to [6], comprising: a Mg-base alloy wherein the area enclosed by the nominal stress-and-nominal strain curve in the stress-strain diagram obtained by the room temperature compression test in which the initial strain rate is set to $1\times10^{-4}$ $s^{-4}$ or less exhibits 100 kJ or more. In an embodiment of the present invention, since the area enclosed by the nominal stress-and-nominal strain curve is at least 100 kJ, the alloy has a large fracture resistance against the fracture as compared to the conventional alloy (for example, AZ31).

[8] In an embodiment of the present invention, a method of manufacturing the Mg-based alloy wrought material is characterized by a method of manufacturing a Mg-based alloy wrought material as described in any one of the above [1] to [7], comprising: performing the solution treatment of a Mg-based alloy cast material having been melted and cast at a temperature of at least 400 degree Celsius and not exceeding 650 degree Celsius for at least 0.5 hours and not exceeding 48 hours and, as a process of applying plastic strain, making the treated Mg-based alloy undergo a hot plastic working at a temperature of at least 50 degree Celsius and not exceeding 550 degree Celsius with at least 70% of cross-section reduction rate. Here, the cross-section reduction rate is a technical term used in the plastic working such as forging and may be defined by the cross-section reduction rate=(cross-section area of raw material−cross-section area of processed material)/cross-section area of raw material×100%. And, for example, a processing method of heating metal at a temperature equal to or higher than the recrystallization temperature and forming the metal into a plate shape, a bar shape, a predetermined shape, etc. may be named as an example of the hot plastic working, but it is not limited thereto. In a cross-section approximately perpendicular to the direction of the expansion forming process of such a plate, a bar, and shaped steel, the ratio of the amount subtracting the cross-section area of the formed product after processing from the cross-section area of the raw material before processing to the cross-section area of the raw material before processing corresponds to the cross-section reduction rate. In such a processing method, an elongated product such as a rail may be produced continuously.

And, a method of manufacturing a Mg-based alloy wrought material may also be provided wherein the method comprises: the step of melting a Mg-based alloy material comprising at least one kind of element from the four kinds of elements: Mn, Zr, Bi, and Sn, and at least one kind of element from the six kinds of elements: Al, Zn, Ca, Li, Y, and Gd (Here, a Mg-based alloy with addition of a Mn—Al combination, a Mg-based alloy with addition of a Mn—Zn combination, a Mg-based alloy with addition of a Mn—Ca combination, a Mg-based alloy with addition of a Mn—Li combination, and a Mg-based alloy with addition of a Mn—Y combination are excluded.) at a temperature of at least 650 degree Celsius;

the step of manufacturing a Mg-based cast material by pouring the thus-obtained melt into a mold;

the step of manufacturing a solution treated Mg-based alloy by performing a solution treatment of the thus-obtained Mg-base cast material at a temperature of at least 400 degree Celsius and not exceeding 650 degree Celsius for at least 0.5 hours and not exceeding 48 hours; and the step of applying plastic strain so as to make the solution treated Mg-based alloy undergo the hot plastic working at a temperature of at least 50 degree Celsius and not exceeding 550 degree Celsius with at least 70% of cross-section reduction rate. Here, it is not necessary for the melting temperature in the melting step to have the upper limit, but it is preferable to be industrially suitable such that, while the boiling temperature of magnesium is 1091 degree Celsius, it is preferable to be lower than this temperature.

[9] In an embodiment of the present invention, the method of manufacturing the Mg-based alloy wrought material is characterized by a method of manufacturing a Mg-based alloy wrought material as described in the above [8], wherein the step of applying plastic strain comprises any one of extruding, forging, rolling, and drawing.

BRIEF EXPLANATIONS OF DRAWINGS

EMBODIMENT CARRYING OUT INVENTION

Figure 1:
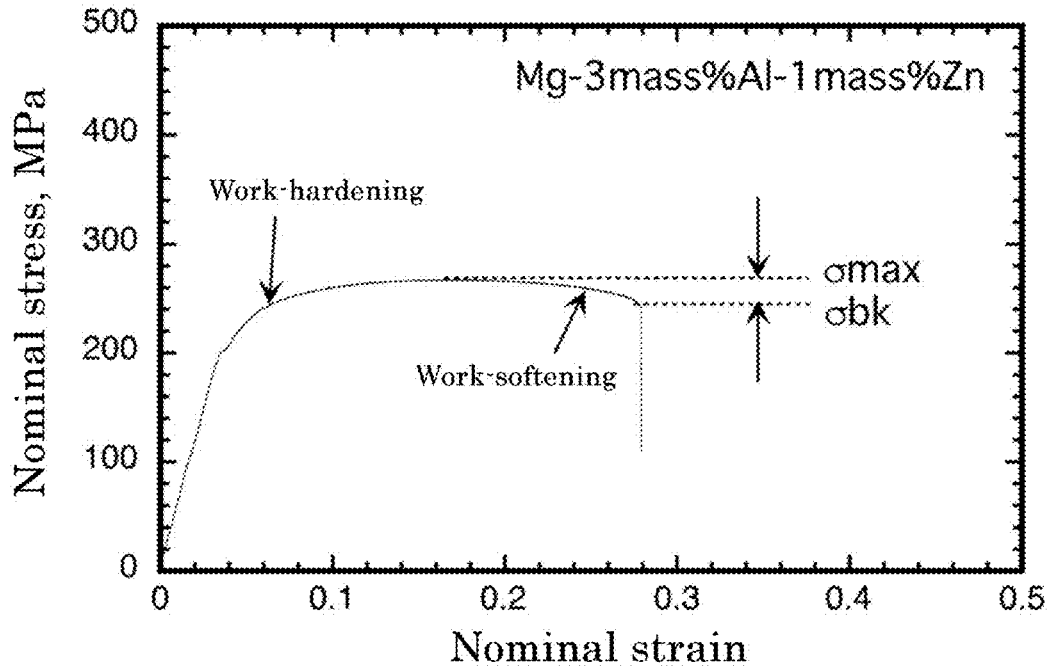
FIG. 1 shows a nominal stress-nominal strain curve obtained by a room temperature tensile test of a Mg-3Al-1Zn alloy extruded material.

In embodiments of the present invention, a Mg-based alloy raw material comprises: Mg-A mol % X-B mol % Z wherein X is any one or more kinds of elements from Mn, Bi, Sn, and Zr and wherein Z is any one or more kinds of elements selected from a group consisting of Al, Zn, Ca, Li, Y, and Gd (Here, a Mg-based alloy with addition of a Mn—Al combination, a Mg-based alloy with addition of a Mn—Zn combination, a Mg-based alloy with addition of a Mn—Ca combination, a Mg-based alloy with addition of a Mn—Li combination, and a Mg-based alloy with addition of a Mn—Y combination are excluded.). With respect to a relationship of A and B, A≥B and a value of A is preferably not exceeding 1 mol %, more preferably not exceeding 0.5 mol %, and yet more preferably not exceeding 0.3 mol %. A lower limit of A is at least 0.03 mol %. An upper limit of B is preferably 1.0 times as large as or less than an upper limit of A, more preferably 0.9 times as large as or less than the upper limit of A, and yet more preferably 0.8 times as large as or less than the upper limit of A. A lower limit of B is at least 0.03 mol %.

Here, 0.03 mol % is a value to define a boundary whether or not the unavoidable impurities are. If a recycled Mg-based alloy is used as a raw material of Mg-based alloy raw material, various kinds of alloy elements may be originally included such that the content amount usually contained therein should be excluded in the case where the Mg-based alloy raw material is used. Examples of elements contained in the unavoidable impurities may include Fe (iron), Si (silicon), Cu (copper), and Ni (nickel).

Figure 5:
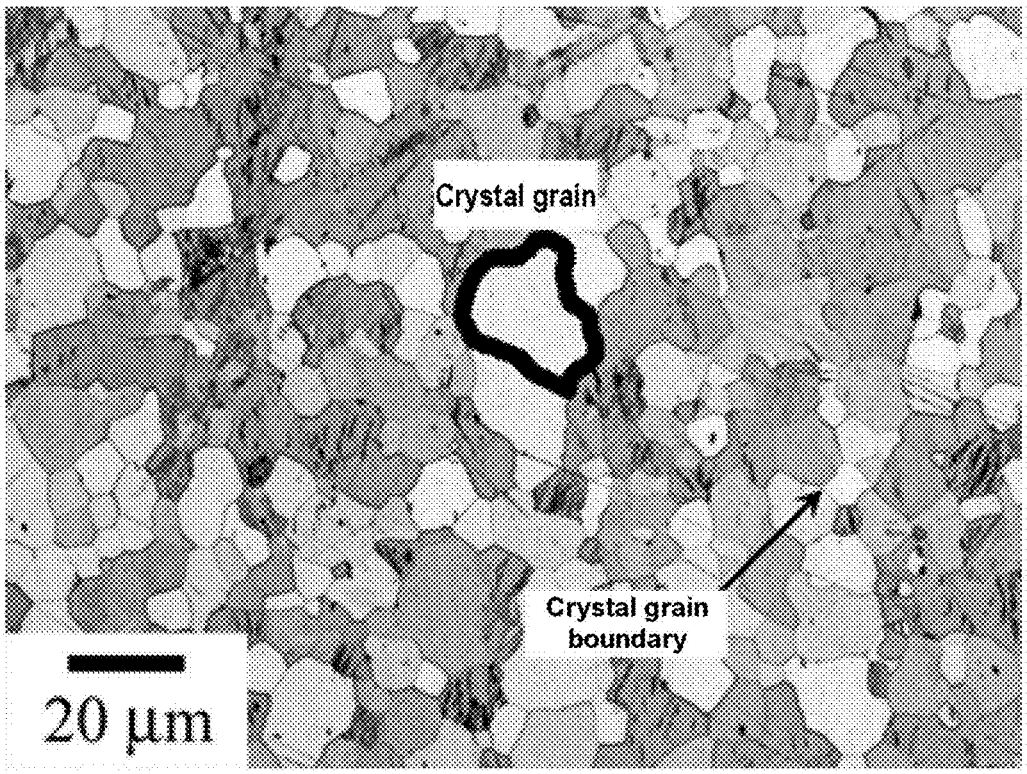
FIG. 5 shows a cross-section microstructure diagram of a comparative embodiment taken by the optical microscope.

The average crystal grain size of the Mg parent phase, that is, crystal grains after hot-working is preferably not exceeding 20 micrometer. More preferably it is not exceeding 10 micrometer and further preferably it is not exceeding 5 micrometer. The measurement of the crystal grain size is preferably conducted by an intersection method (G 0551: 2013) based on the JIS standard through the optical microscope observation of the intersection (A conceptual diagram in which crystal grains and grain boundaries appear in the optical microscopic field of view is shown in FIG. 5.). In the case where the crystal grain size is so fine or crystal grain boundaries are not so clear, it is not easy to employ the intersection method such that the measurement may be conducted by the bright-field image and the dark-field image obtained by the transmission electron microscope observation or the electron backscatter diffraction image. Here, in the case where the crystal grain size is larger than 20 micrometer, the grain boundary compatibility stress arising near the crystal grain boundaries does not affect all region of grain interior. That is to say, it is difficult for the non-basal dislocation slip to make an occurrence in all region of grain interior such that it cannot be expected that the ductility would be improved. If the average crystal grain size is not exceeding 20 micrometer, of course, the intermetallic compounds having the size of 0.5 micrometer or less could be dispersed inside the Mg crystal grains and the crystal grain boundaries. And if the average crystal grain size is maintained not exceeding 20 micrometer, it is OK to conduct a heat treatment such as a strain annihilation via annealing after the hot working. It is of course concerned that the crystal grain size may be coursened by the strain relief annealing, but there are no problems as far as the average crystalline grain sie of the Mg parent phase is not exceeding 20 micrometer. Here, it is OK either the added elements may be segregated or may not be segregated at the crystal grain boundaries. The temperature and the treatment time of the stress annihilation via annealing are 100 degree Celsius or higher and 400 degree Celsius or lower and 48 hours or less, respectively. Preferably, they are 125 degree Celsius or higher and 350 degree Celsius or lower and 24 hours or less, more preferably 150 degree Celsius or higher and 300 degree Celsius or lower and 12 hours or less, respectively.

Next, a method of manufacturing in order to obtain a fine structure will be explained. The solution treatment is performed with respect to the melt Mg-based alloy cast material at a temperature of at least 400 degree Celsius and not exceeding 650 degree Celsius. Here, in the case where the temperature of the solution treatment is less than 400 degree Celsius, it is not preferable from the industrial point of view since it is necessary to hold the temperature for a long period of time in order to have the added solute elements homogeneously solid solved. On the other hand, if the temperature exceeds 650 degree Celsius, it may not be safe for operation since the localized melting begins because it is at a solid phase temperature or higher. And the period of time for the solution treatment is at least 0.5 hours and not exceeding 48 hours. If it is less than 0.5 hours, it is insufficient for the solute elements to be dispersed in all region inside the parent phase such that segregation during the casting remains and a good raw material cannot be manufactured. If it is longer than 48 hours, the operation time becomes longer so as not to be preferable from the industrial point of view. With respect to the casting method, any method such as gravity casting, sand casting, die casting, etc. that can manufacture the Mg-based alloy cast material of the present invention of course may be employed.

After the solution treatment, a hot strain application process is conducted. The temperature during the hot working is preferably at least 50 degree Celsius and not exceeding 550 degree Celsius; more preferably at least 75 degree Celsius and not exceeding 525 degree Celsius; and further preferably at least 100 degree Celsius and not exceeding 500 degree Celsius. If the working temperature is less than 50 degree Celsius, so many deformation twins that may be an origin of break or crack are caused such that a good wrought material could not be manufactured. If the working temperature is higher than 550 degree Celsius, the recrystallization may proceed during the working process such that refinement of the crystal grains would be prevented and further cause the lifetime of the mold for the working to be shortened.

The application of strain during the hot working is characterized by the total cross-section reduction rate of at least 70%, preferably at least 80%, and more preferably at least 90%. If the total cross-section reduction rate is less than 70%, the strain application is not enough such that the crystal grain size cannot be refined. It is also considered that the structure with a mixture of fine grains and coarse grains may be formed. In such a case, the room temperature ductility is lowered because the coarse crystal grain may become a fracture origin. With respect to the hot working process, typically extruding, forging, rolling, drawing and so on may be representative, but any processing method that is a plastic working method that can apply strain could be employed. However, it is not preferable only to perform the solution treatment for the cast material without conducting the hot working since the crystal grain size in the Mg parent phase tends to be coarse.

Now, the indices to evaluate the ductility and formability of the Mg-based alloy wrought material at the room temperature, that is, the degree of stress reduction and the resistance (hereinafter defined as F) against the fracture are explained. Both indices could be calculated from the nominal stress-and-nominal strain curves obtained by the room temperature tensile test and compression test, respectively. Here, it is assumed that the nominal stress-and-nominal strain curves are obtained with the initial strain rate of $1\times10^{-4}$ $s^{-4}$ or lower in both tensile and compression tests.

Figure 2:
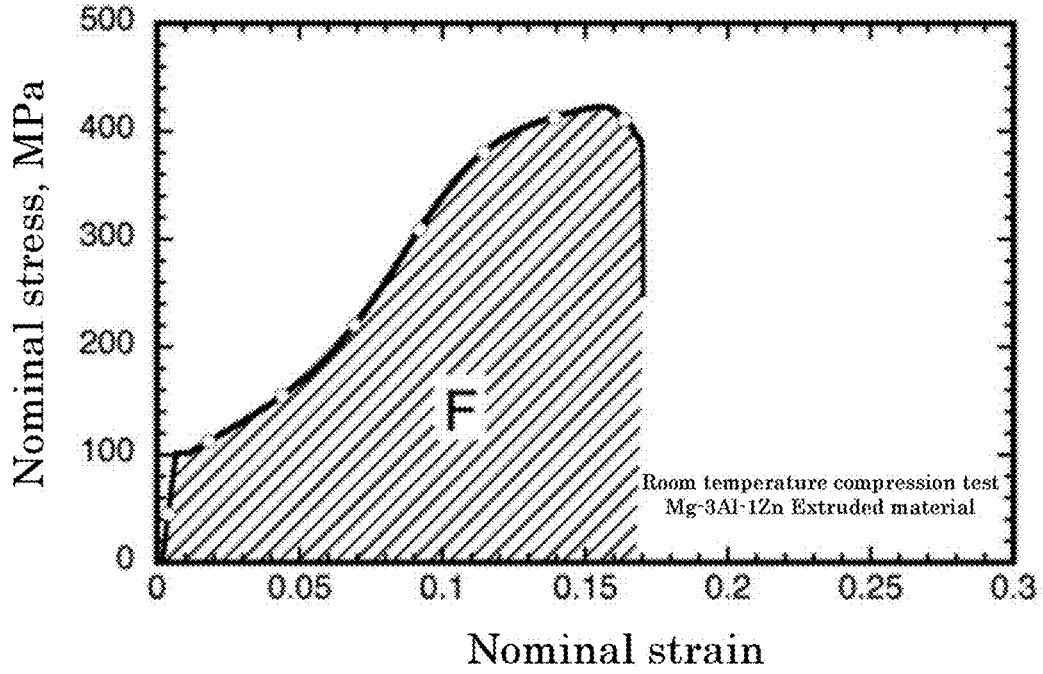
FIG. 2 shows a nominal stress-nominal strain curve obtained by a room temperature compression test of the Mg-3Al-1Zn alloy extruded material.

In FIGS. 1 and 2, the nominal stress-and-nominal strain curves obtained by the room temperature tensile test and compression test using a commercially available magnesium alloy (Mg-3 mass % Al-1 mass % Zn: commonly known as AZ31) are shown. In the stress-strain curve during the tensile test as shown in FIG. 1, a slight work-hardening occurs after yielding, and then, the specimen breaks when the nominal strain reaches about 0.2. On the other hand, in the stress-strain curve during the compression test as shown in FIG. 2, a large work-hardening occurs after yielding, and then, the specimen breaks around 0.2 of the nominal strain. In both tensile and compression tests, it should be understood that the specimens break at an early stage of deformation with respect to the conventional Mg-based alloy.

The degree of stress reduction may be obtained by the formula (1) and preferably is at least 0.2 and more preferably is at least 0.25.

[Formula 1]

$$\text{Degree of stress reduction} = \frac{\sigma_{max} - \sigma_{bk}}{\sigma_{max}} \quad \text{(Formula 1)}$$

Here, $\sigma_{max}$ is the maximum applied stress and $\sigma_{bk}$ is the stress at break and their examples are shown in FIG. 1.

Next, the resistance against the fracture: F corresponds to the area enclosed by the nominal stress-and-nominal strain curve obtained by the room temperature compression test as shown in FIG. 2 and the larger the area is, the larger the resistance against the fracture (=energy absorption capacity) is. The F tends to increase as the testing rate is speeded up since it is affected by the strain rate. Therefore, when the value of F may be obtained under the condition that the initial strain rate is $1\times10^{-4}$ $s^{-1}$, it is preferably 100 kJ or more, and more preferably 150 kJ or more, and yet more preferably 200 kJ or more. Here, a similar nominal stress-and-nominal strain curve (FIG. 1) to that of the compression test can be obtained by the tensile test, but the resistance against the fracture may be evaluated more strictly by the compression test than by the tensile test since the specimen breaks with a slight nominal strain in the case of the Mg-based alloy. The above-mentioned enclosed area may be obtained, for example, by integrating the stress-strain curve, where the nominal stress is taken on the horizontal axis and the nominal strain is taken on the vertical axis, from 0 strain to the breaking strain.

Embodiments

A Mg—Y mother alloy was manufactured by setting a commercially available pure Y (99.9 mass %) (yttrium (purity: 99.9 mass %) by Kojundo Chemical Laboratory Co., Ltd.) and a commercially available pure Mg (99.98 mass %) (magnesium (purity: 99.98 mass %) by OSAKA FUJI Corporation) into an employed iron crucible. In the case where Mn and Y were added, the mother alloy was employed, and in the case where an element or elements other than them were added, a commercially available pure element was employed and the amounts of the element or elements were adjusted so that the target content amouts summarized in Table 1 were set to be 0.15 mol % Bi-0.15 mol % Zn, and then various kinds of cast materials were melted with the iron crucible. Here, the cast material was made by melting the composition in an Ar atmosphere at a melting temperature of 700 degree Celsius for a melt holding time of 5 minutes and pouring the melt into an iron mold having a diameter of 50 mm and a height of 200 mm. Then, the cast material was heat-treated for the solution treatment at 500 degree Celsius for 8 hours.

The cast material after the solution treatment was machined into a cylindrical extrusion billet having a diameter of 40 mm and a length of 60 mm by the machine working. After the thus-machined billet was held in a container kept at 200 degree Celsius for 30 minutes, an extruded material in a shape having a diameter of 8 mm and a length of 500 mm or longer (hereinafter referred to as "extruded material") was manufactured by the extrusion with the extrusion ratio of 25:1 (=reduction rate: 94%) through the hot strain application process.

Figure 3:
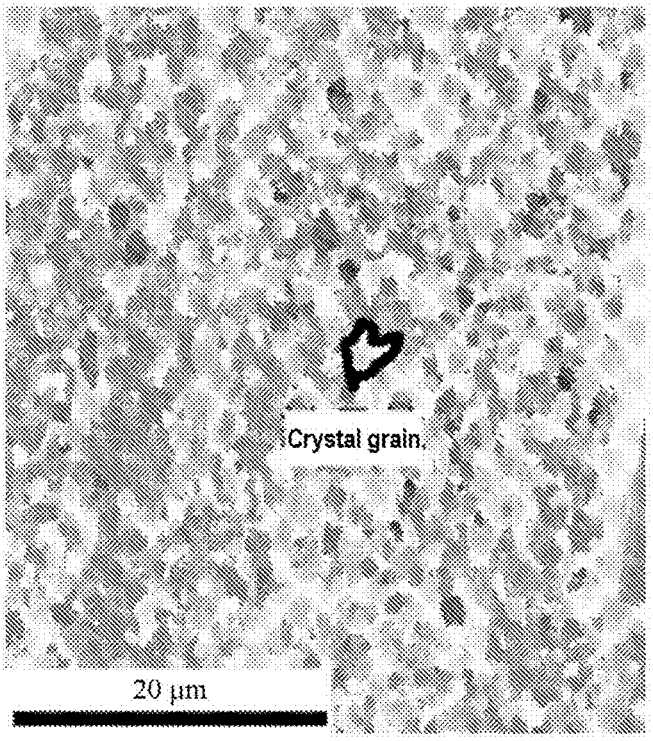
FIG. 3 shows a microstructure diagram of a Mg-based alloy extruded material of an embodiment taken by the electron backscatter diffraction.
Figure 4:
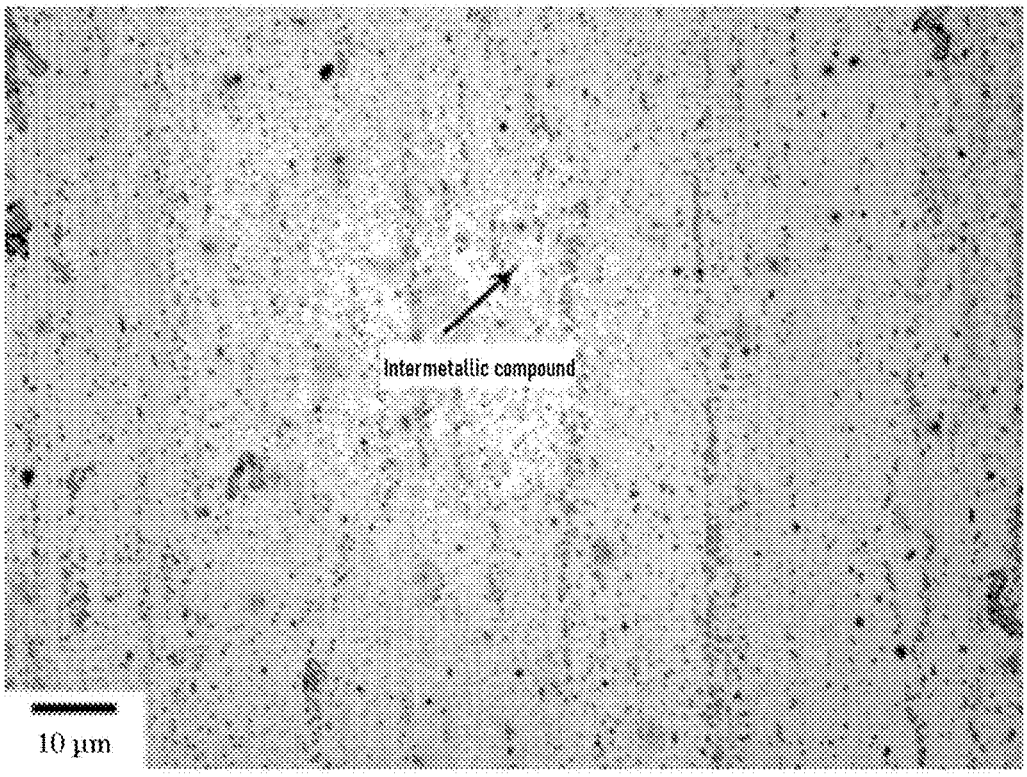
FIG. 4 shows a cross-section microstructure diagram of an embodiment taken by the optical microscope.

Microstructures of the respective kinds of extruded materials were observed and was taken by the optical microscope or the electron backscatter diffraction method. A microstructural image observed with the electron backscatter diffraction method is shown in FIG. 3. A portion composed of the same contrast indicates one crystal grain and average crystal grain sizes of the respective extruded materials are summarized in Table 1. In any of the extruded materials, the average crystal grain sizea were 10 micrometer or less. And an example of an optical microscope observation after mirror polishing is shown in FIG. 4. As showm with an arrow in the figure, particles exhibiting a black color, that is, intermetallic compound particles can be confirmed. It can be confirmed that these sizes represent that the diameters are about 500 nm.

With respect to specimens cut out of the Mg-based alloy extruded material, a room temperature tensile test was conducted with the initial strain rate of $1\times10^{-4}$ $s^{-1}$. Round bar specimens having a gauge length of 10 mm and a gauge diameter of 2.5 mm were used with the all tensile tests. When the stress was suddenly dropped (20% during each measurement), it was defined as "breaking" such that the nominal strain at the time of breaking is referred to as the tensile breaking strain, which is summarized in Table 1. It should be understood that every tensile breaking strain of the extruded materials exceeds 0.03 so as to exhibit an excellent tensile ductility.

TABLE 1

| No. | | | T, ° C. | d, μm | Heat treatment | v; 1e-5/s F, kJ | eC | eT | Degree of stress reduction | Particle diameter of intermetallic compound in parent phases/ grain boundaries, μm |
|---|---|---|---|---|---|---|---|---|---|---|
| 1 | Extruded material | Mg—0.15Bi—0.15Zn | 200 | 8 | x | 149 | 0.31 | 0.48 | 0.28 | 0.5 |
| 2 | Extruded material | Mg—0.3Bi—0.1Li | 150 | ≤5 | x | 168 | ≥0.5 | 1.48 | 0.85 | 0.4 |
| 3 | Extruded material | Mg—0.3Bi—0.1Li | 150 | ≤8 | o | ≥150 | 0.4 | ≥0.25 | ≥0.25 | 0.4 |
| 4 | Extruded material | Mg—0.3Bi—0.1Ca | 160 | ≤5 | x | 200 | ≥0.5 | 0.22 | ≥0.3 | 0.5 |
| 5 | Extruded material | Mg—0.3Bi—0.1Ca | 160 | ≤8 | o | ≥150 | ≥0.5 | ≥0.25 | ≥0.25 | 0.5 |
| 6 | Extruded material | Mg—0.3Bi—0.1Sn | 170 | ≤5 | x | 317 | 0.25 | 0.28 | ≥0.3 | 0.4 |
| 7 | Extruded material | Mg—0.3Bi—0.1Sn | 170 | ≤8 | o | ≥150 | 0.3 | ≥0.25 | ≥0.25 | 0.4 |
| 8 | Extruded material | Mg—0.3Bi—0.1Al | 180 | ≤5 | x | 264 | 0.23 | 0.31 | ≥0.25 | 0.5 |
| 9 | Extruded material | Mg—0.3Bi—0.1Al | 180 | ≤8 | o | ≥150 | 0.3 | ≥0.25 | ≥0.25 | 0.5 |
| 10 | Extruded material | Mg—0.3Bi—0.1Zn | 170 | ≤5 | x | 284 | 0.25 | 0.25 | 0.25 | 0.5 |
| 11 | Extruded material | Mg—0.3Bi—0.1Zn | 170 | ≤8 | o | ≥150 | 0.3 | ≥0.25 | ≥0.25 | 0.5 |
| 12 | Groove-rolled material | Mg—0.3Bi—0.1Zn | 400 | ≤5 | x | ≥150 | 0.3 | ≥0.25 | ≥0.25 | 0.5 |
| 13 | Groove-rolled material | Mg—0.3Bi—0.1Al | 400 | ≤5 | x | ≥150 | 0.3 | ≥0.25 | ≥0.25 | 0.4 |
| 14 | Groove-rolled material | Mg—0.3Bi—0.1Y | 400 | ≤5 | x | ≥150 | 0.3 | ≥0.25 | ≥0.25 | 0.5 |
| | Comparative material | AZ31 | — | 20 | | 197 | 0.15 | 0.2 | 0.10 | None |

T: Extrusion temperature
d: Average crystal grain size
v: Strain rate
eC: Compression breaking strain
eT: Tensile breaking strain
F: Absorption energy for fracture Further, since the value of the stress reduction: $(\sigma_{max}-\sigma_{bk})/\sigma_{max}$ of 0.15 mol % Bi-0.15 mol % Zn alloy extruded material indicates 0.28, in the embodiment of the present invention, it is suggested that the plastic deformation limit of the alloy is large and the formability thereof is excellent. From Table 1, it should be understood that every value of $(\sigma_{max}-\sigma_{bk})/\sigma_{max}$ of the extruded materials is larger than that of the commercially available magnesium alloy: AZ31 such that an excellent formability is shown.

The resistance against the fracture (=energy absorption capacity) was evaluated by the room temperature compression test. A cylindrical test piece having a height of 8 mm and a diameter of 4 mm was cut out of each Mg-based alloy extruded material in the parallel direction to the extrusion direction. With respect to every test piece, the room temperature compression test was conducted with the initial strain rate of $1\times10^{-5}$ $s^{-1}$. The area enclosed by the stress-strain curve as shown in FIG. 2 was obtained and the results are listed in the column F of Table 1.

Here, the process procedures of the groove-rolling process are described as follows. Each kind of cast material after the solution treatment was machined into a cylindrical extrusion billet having a diameter of 40 mm and a length of 80 mm through the mechanical working. The thus-machined billet was held in an electric furnace kept at 400 degree Celsius for 30 minutes or longer. Then, rolling was repeatedly performed in the condition that the rolling temperature was set to the room temperature and that the cross-section reduction rate for one rolling was set to 18% such that the total cross-section reduction rate might be 92%. (Hereinafter, it is referred to as "groove-rolled material".) The tensil test and the compression test were performed with test pieces having the same shape and the same condition as the above-mentioned extruded material, which were cut out in the parallel direction to the rolling direction.

Further, the effect of the crystal grain size on the resistance against the fracture and the degree of stress reduction was investigated. In order to coarsen the size of Mg parent phase, each kind of the Mg-based alloy extruded materials was held in a muffle furnace kept at 200 degree Celsius in an air atmosphere for one hour such that the heat treatment (strain annihilation via annealing) was performed. Then, the room temperature tensile and compression tests were performed in the same procedures as mentioned above. The obtained results are summarized in Table 1. It can be confirmed that excellent values are shown as compared to those of the commercially available magnesium alloy: AZ31 even if the average crystal grain sizes were coarsened by the heat treatment. In the case where o is shown in the heat treatment column in Table 1, it means that the heat treatment as mentioned here was performed while in the case where x is shown, it means that the heat treatment as mentioned here was not performed.

Comparative Embodiment

The room temperature tensile and compression tests were performed with the extruded material of the commercially available magnesium alloy (Mg-3 mass % Al-1 mass % Zn: commonly know as AZ31). The same test piece size and shape and the same test condition were employed as those of the above-mentioned embodiments. The breaking elongations, degrees of stress reduction, values of F, and so on obtained by the tensile and compression tests are summarized in Table 1. And a microstructural image observed with the optical microscope is shown in FIG. 5. The crystal grain boundaries are indicated by line in a black color and the area enclosed by a black line corresponds to one crystal grain. A typical example of the crystal grain is enclosed with a black bold line and shown in the figure. It should be understood that the crystal grain size is at least 20 micrometer.

Here, in embodiments of the present invention, the refinement of the internal structure was attempted by the one-time plastic-strain application method, but the plastic-strain application can be performed for a plurality of times in the case where the cross-section reduction rate is smaller than a predetermined value.

INDUSTRIAL APPLICABILITY

The Mg-based alloy of the present invention exhibits an excellent room temperature ductility so as to have a good secondary workability and be easily formed into a complicated shape such as a plate shape. In particular, it has an excellent property for the stretch forming, the deep drawing, and so on. And, since the grain boundary sliding is caused, it has an excellent internal friction property so as to be applied possibly to the part in which vibration and noise are to be a technical problem. Further, since a small amount of versatile element is added such that the rare earth element is not used, it is possible to reduce the price of the raw material as compared to the conventional rare earth added Mg alloy.

EXPLANATION OF REFERENCE NUMERALS $\sigma_{max}$ maximum applied stress;

$\sigma_{bk}$ stress at beak:

F resistance against fracture (=energy absorption capacity)

What is claimed is:

1. A Mg-based alloy wrought material consisting of Mg-A mol % X-B mol % Z wherein a remainder consists of Mg and unavoidable impurities, wherein X is Bi, wherein Z is at least one kind of element from Al and Li, wherein a value of A is at least 0.03 mol % and not exceeding 1 mol %, wherein, with respect to a relationship of A and B, A≥B and a lower limit of B is at least 0.03 mol %, and wherein an average crystal grain size of the Mg-based alloy wrought material is not exceeding 20 micrometer.

2. The Mg-based alloy wrought material according to claim 1, wherein intermetallic compound particles having an average diameter of not exceeding 0.5 micrometer exist in Mg parent phase or crystal grain boundaries of a metallographic structure of the Mg-based alloy wrought material.

3. The Mg-based alloy wrought material according to claim 1, wherein a value of a formula of $(\sigma_{max}-\sigma_{bk})/\sigma_{max}$ is at least 0.2 when a maximum applied stress is defined as $(\sigma_{max})$ and a stress at breaking is defined as $(\sigma_{bk})$ in a stress-strain diagram obtained by a room temperature tensile test in which an initial strain rate of the wrought material is set to not exceeding $1\times10^{-4}$ $s^{-1}$.

4. The Mg-based alloy wrought material according to claim 1, wherein the Mg-based alloy does not break even if a nominal strain of at least 0.2 is applied in a room temperature tensile test or compression test in which an initial strain rate is set to not exceeding $1\times10^{-4}$ $s^{-1}$.

5. The Mg-based alloy wrought material according to claim 1, wherein an area enclosed by a nominal stress and nominal strain curve in a stress-strain diagram obtained by a room temperature compression test in which an initial strain rate is set to not exceeding $1\times10^{-4}$ $s^{-1}$ exhibits at least 100 kJ.

6. A method of manufacturing a Mg-based alloy wrought material as defined in claim 1, comprising the steps of:

melting a raw material having a substantially same constituent ratios as the Mg-based alloy wrought material consisting of: A mol % X and B mol % Z, wherein a remainder thereof consists of Mg and unavoidable impurities, at a temperature of at least 650 degree Celsius, wherein X is Bi wherein Z is at least one kind of element from Al and Li, wherein a value of A is at least 0.03 mol % and not exceeding 1 mol %, wherein, with respect to a relationship of A and B, A≥B and a lower limit of B is at least 0.03 mol %;

manufacturing a Mg-based cast material by pouring a thus-obtained melt into a mold;

manufacturing a solution treated Mg-based alloy by performing a solution treatment of a thus-obtained Mg-based cast material at a temperature of at least 400 degree Celsius and not exceeding 650 degree Celsius for at least 0.5 hours and not exceeding 48 hours; and applying plastic strain so as to make the solution treated Mg-based alloy undergo hot plastic working at a temperature of at least 50 degree Celsius and not exceeding 550 degree Celsius with at least 70% of cross-section reduction rate.

7. The method of manufacturing the Mg-based alloy according to claim 6, wherein the step of applying plastic strain comprises any one of extruding, forging, rolling, and drawing.

* * * * *